United States Patent [19]

Arita et al.

[11] 4,337,089

[45] Jun. 29, 1982

[54] COPPER-NICKEL-TIN ALLOYS FOR LEAD CONDUCTOR MATERIALS FOR INTEGRATED CIRCUITS AND A METHOD FOR PRODUCING THE SAME

[75] Inventors: Kishio Arita, Mito; Kiyoshi Murakawa, Tokyo; Toshio Takahashi, Hachioji, all of Japan

[73] Assignees: Nippon Telegraph and Telephone Public Corporation; Nippon Bell Parts Co., Ltd., both of Tokyo; Nihon Telecommunication Engineering Corporation, Musashino, all of Japan

[21] Appl. No.: 220,352

[22] Filed: Dec. 29, 1980

[30] Foreign Application Priority Data

Jul. 25, 1980 [JP] Japan ..... 55-101273

[51] Int. Cl.[3] ..... C22C 9/02; C22C 9/06

[52] U.S. Cl. ..... 420/472; 148/2; 148/11.5 C; 148/12.7 C; 420/59; 420/473

[58] Field of Search ..... 75/159, 154; 148/11.5 C, 12.7 C, 160, 2

[56] References Cited

U.S. PATENT DOCUMENTS 2,155,405 4/1939 Crampton et al. ..... 75/159

2,375,285 5/1945 Crampton et al. ..... 148/12.7 C

*Primary Examiner*—Peter K. Skiff

*Attorney, Agent, or Firm*—Silverman, Cass & Singer, Ltd.

[57] ABSTRACT

Copper-nickel-tin alloys having high tensile strength and conductivity suitable for lead conductor materials for integrated circuits are produced by melting a starting material containing 0.5–3.0% by weight of Ni, 0.3–0.9% by weight of Sn, 0.01–0.2% by weight of phosphorus and 0–0.35% by weight of at least one of Mn and Si other than Cu, casting the molten metal, rolling conventionally the cast into a sheet having a thickness corresponding to more than 60% of cold reduction rate of the final necessary gauge, annealing such a rolled sheet at a temperature of 300–395° C. for 1 hour, cold rolling the annealed sheet and annealing the cold rolled sheet at a temperature of 150–250° C. for 1 hour.

2 Claims, 2 Drawing Figures

Figure 1:
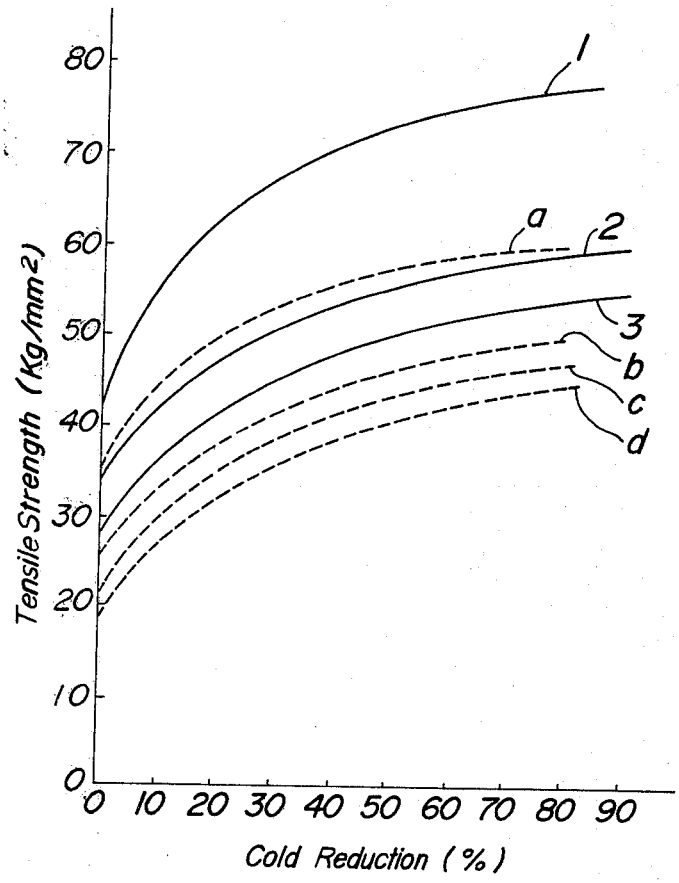

COPPER-NICKEL-TIN ALLOYS FOR LEAD CONDUCTOR MATERIALS FOR INTEGRATED CIRCUITS AND A METHOD FOR PRODUCING THE SAME

The present invention relates to lead frame materials for integrated circuits which are high in the tensile strength and conductivity at an elongation of more than 6% and are excellent in the metal plating property and economy. For lead conductor materials for integrated circuits, alloys which are high in tensile strength and conductivity at a state ensuring an elongation at which the bending can be made and are excellent in view of economy, are required. However, the strength and the conductivity are generally reverse properties and the practical use has been made by sacrificing either one of the properties. At present, phosphor bronze (about 45 kg/mm$^2$ of tensile strength at elongation of more than several %, about 15% of conductivity), red brass (35 kg/mm$^2$ of tensile strength, 37% of conductivity), beryllium copper (46–80 kg/mm$^2$ of tensile strength, less than 37% of conductivity), and silver copper (45 kg/mm$^2$ of tensile strength, 85% of conductivity) heretofore produced, alloys (35–50 kg/mm$^2$ of tensile strength, 35–60% of conductivity) recently developed and containing P, Co, Sn and Zn other than Fe have been used. Various copper alloys other than these alloys are similar in the properties to the above described alloys. A common problem in the above described alloys is that the materials are expensive.

In general, each alloy utilizes the precipitation aging in order to improve the strength and the cost for heat treatment is necessarily increased. If it is assumed that this cost is equal, the essential factor determining economic preference is the elements composing the alloy. In this point, copper alloys added with Ti, Zr, Cr and the like as an additive element which improves the strength in a slight addition amount and does not lower the conductivity, have been taken into consideration. However, when an element having a high melting point and a high oxidizing property is added, it is difficult to form a homogeneous solid solution of said elements and copper and to effect the precipitation hardening and the production cost is raised in the other view. Accordingly, the precipitation hardening type alloys containing Ti, Zr, Cr and the like have not been produced in mass production.

A prior alloy most similar to the alloys of the present invention is phosphor bronze but this alloy contains 3–9% of Sn and 0.03–0.35% of P and expensive element Sn as mentioned above is contained in a large amount and the cost becomes high.

An object of the present invention is to provide lead conductor materials for integrated circuits having low cost and high mechanical and electrical properties which have never been heretofore obtained, which consists of copper alloys having high tensile strength and high conductivity and high economy because even though Ni and Sn are contained, the content of these elements is low and the precipitation aging treatment is not needed.

The present invention consists in copper alloys characterized in that 0.5–3.0% by weight of nickel, 0.3–0.9% by weight of tin, 0.01–0.2% by weight of phosphorus and 0–0.35% by weight of one or both of manganese and silicon, and a method of producing the sheet characterized in that the above mentioned alloy ingot is subjected to heating and cold rolling reduction, then annealed for one hour at 300°–395° C., followed by cold reduction of at least 60% by rolling to the required thickness, and is finally annealed at 150°–250° C. for one hour.

The present invention will be explained in more detail.

Figure 2:
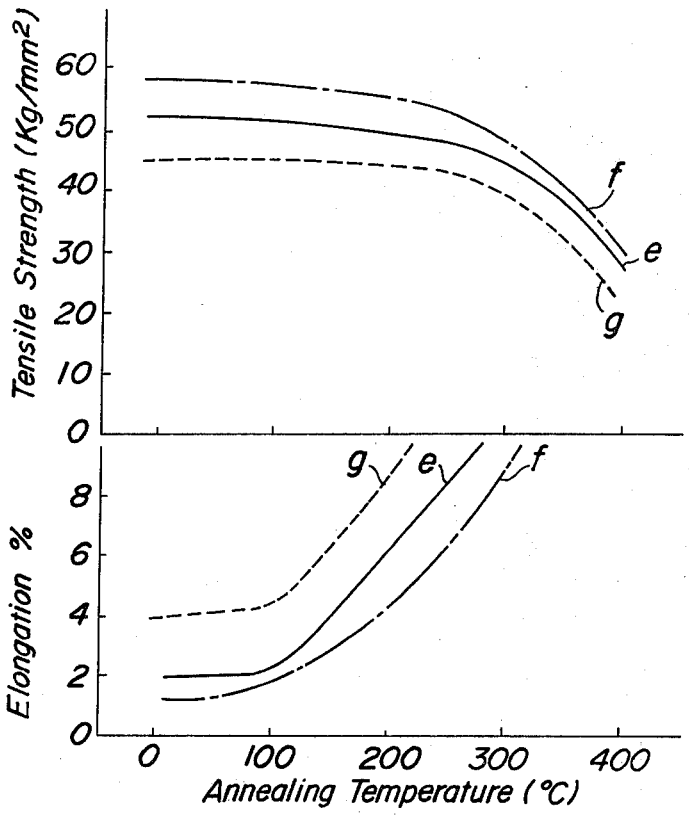

For better understanding of the invention, reference is taken to the accompanying drawings, wherein:

FIG. 1 is a graph showing the relation of the tensile strength to the cold reduction of the copper alloys according to the present invention; and FIG. 2 is a graph showing the relation of the tensile strength and elongation to the annealing temperature of the copper alloys according to the present invention.

In FIG. 1, (1)–(3) are alloys for defining the component range of the present invention and in a composition of x% Sn-1% Ni-0.25–0.05% P-Cu, x in (1), (2) and (3) is 3.0, 0.7 and 0.5 respectively. (a), (b), (c) and (d) are copper alloys having a composition of x% Ni-Cu, wherein x in (a), (b), (c) and (d) is 9, 5, 2 and 1 respectively. In FIG. 2. (e), (f) and (g) are copper alloys according to the present invention and in Ni-Sn-P addition amount, (e) is 1.0–0.5–0.05, (f) is 1.2–0.9–0.2 and (g) is 0.5–0.3–0.01.

Heretofore, the strengthening of usual alloys as well as copper alloys has been attained by the precipitation effect. On the other hand, the conductivity is higher as the amount of additive element is smaller. However, the lowering of the conductivity due to the additive element varies depending upon the kind of element, so that it is possible to ensure the tensile strength and to maintain a certain degree of conductivity.

In order to balance the tensile strength and the conductivity which are in the reverse relation as described above, the present invention makes an amount of the elements added to copper smaller to prevent the lowering of the conductivity and it is attempted thereby to reduce the cost of the starting material. However, this is disadvantageous in view of increase of the mechanical strength. Thus, in the present invention, phosphorus is added to copper, nickel and tin, so that the defined amount of phosphorus is remained after the decarburization. But these additive elements do not expect the precipitation hardening but aim at hardening due to solid solution and further at the work hardening. As the result, about 60 kg/mm$^2$ of tensile strength at elongation of more than 6% is obtained in the composition of 3.0–0.5% of Ni, 0.9–0.3% of Sn, 0.2–0.01% of P and 0–0.35% of one or both of Si and Mn by combining the heat treatments and cold rolling mentioned hereinafter. "6% of elongation" means to provide the mechanical property necessary for the bend working.

In general, the properties of metal materials vary depending upon the working process and the heat treating process. In the alloys of the present invention, this is same but in order to obtain high tensile strength at elongation of more than 6%, it is necessary that when the alloy sheet reaches the thickness which can obtain more than 60% based on the required thickness, of reduction percent by repeating the cold working, the alloy sheet is annealed at a temperature of 300° C.–395° C. for 1 hour (final annealing), cold rolled to obtain the work-hardened sheet and then the work-hardened sheet is annealed at a temperature of 150° C.–250° C. This relation is shown in the following Table 1.

TABLE 1

| Final grain-size defining annealing temperature (F.A.) (°C.) | Cold reduction percent after F.A. (%) | Internal Stress relieving annealing (°C.) | Mechanical property | |
|---|---|---|---|---|
| | | | Elongation (%) | Tensile strength (kg/mm²) |
| 550 | 50 | not annealed | 4.0 | 43 |
| 450 | 60 | 200 | 5.0 | 45 |
| 375 | 75 | 200 | 6.2 | 50 |
| 300 | 90 | 200 | 4.5 | 53 |

In general, when the annealing is effected at higher temperature, the elongation becomes higher but the tensile strength becomes lower. However, it has been found that the alloys of the present invention are somewhat different and are readily work-hardened and the work-hardened sheet is small in the lowering of strength owing to the annealing and the tensile strength at 6% of elongation is several tens kg/mm$^2$.

The variation of the mechanical properties owing to the above described working and annealing is influenced by the composition. Thus, it is considered from the result of the present invention that the work hardening is provided mainly by Sn, while the elongation is obtained mainly by Ni. From FIG. 1 it can be seen that the copper alloys ((1), (2) and (3)) which contain 1% of Ni and further are added with Sn, are higher in the work hardening effect than the copper alloys (a), (b), (c) and (d) added with only Ni. And the hardening effect is higher in the range where the reduction percent is higher. It is the basic characteristic of the present invention that in the lower range of amount of Sn added, for example the alloys (2) and (3) have this effect and it is not necessary to contain more than 1% of Sn as in the prior alloys. When tin is more than 0.3%, the work hardening percent shows substantially the same tendency in the range of the cold reduction percent of more than 60% as in the case containing a large amount of Sn. The lower limit of the amount of Sn is the value at which the above described result is obtained and when the reduction percent is raised, about 50 kg/mm$^2$ of tensile strength is obtained. The lower limit of Sn is the value at which about 50 kg/mm$^2$ of tensile strength is obtained when the cold reduction percent is raised. The upper limit of Sn amount is preferred to be higher, because the larger Sn amount, the higher the tensile strength is, but the conductivity is lowered. Accordingly, in order to obtain the conductivity of more than about 35% in the coexistence of Ni, P, Si and Mn, the upper limit of Sn is preferred to be 0.9% by weight.

As mentioned above, Ni improves the elongation. In general, in order to increase the elongation by annealing after working, it is generally necessary to effect the annealing at a fairly high temperature. In this case, the tensile strength is inevitably lowered. However, in the alloys of the present invention, the elongation is improved within the temperature range at which the tensile strength is not lowered as shown in FIG. 2. This, of course, relates to the steps of rolling and annealing and the structure of the obtained metals as mentioned above. In the step of the present invention, fine globular grains having a diameter of about 20 $\mu$m are formed and this is essential for obtaining the elongation. The above described structure is probably obtained in other alloys. The above described effect becomes noticeable by containing at least 0.5% of Ni. The upper limit of Ni is determined by the relation of the economy and the conductivity. That is, when Ni exceeds 3.0% by weight in coexistence of P, Sn, Si and Mn, the conductivity becomes less than about 35% and this value is not adequate for the lead frame material. Ni is the most expensive among the composition elements, so that the concentration is preferred to be lower in view of the cost of the starting material. It has been mentioned herein that Ni greatly contributes to the elongation but furthermore Ni contributes to increase of the strength as shown in FIG. 1.

As mentioned above, event when the elements Si and Mn are not added, the satisfactory strength is obtained. However, the tensile strength when annealing can be more or less increased by adding these elements as shown in Table 2. This effect for improving the strength ranks next to Sn. In the present invention, these elements are added up to 0.35% and about 35% of conductivity is obtained in the coexistence of the other elements. Concerning phosphorus, Cu-P mother alloy is used as a deoxidizing agent as usual but it is necessary that a slight amount of phosphorus is remained. However, since phosphorus greatly lowers the conductivity, the amount is preferred to be 0.15–0.05%. Even if phosphorus is contained in an amount of 0.3–0.9% by weight, the conductivity of more than 35% can be obtained in the coexistence of other elements and the effect for improving the strength can be ensured.

The following examples are given for the purpose of illustration of this invention and are not intended as limitations thereof.

EXAMPLES 2.5 kg or 100 kg of typical alloys as shown in Table 2 was melted in air and cast into a circular or cubic ingot. The ingots were forged at a temperature of 600°–900° C. and then cold rolled to prepare sheets having a thickness of 6–10 mm. Then, the prepared sheet was cut and ground on surface and used for experiments of a variety of steps. In a standard production process, the specimen having the above described thickness was cold rolled and annealed (500° C.) repeatedly into a sheet having a thickness of 1 mm. The sheet was annealed at 375° C. for 1 hour and cold rolled into a thickness of 0.25 mm. The final cold rolling reduction was 75%. Then, the cold rolled sheet was annealed at a temperature of 150°–250° C. for 1 hour and the thus treated sheet was slit into a breadth of 25 mm and the formed sheet was measured with respect to the mechanical properties and conductivity. The obtained properties of each alloy are shown in the following Table 2. With respect to the lead conductor material for integrated circuit, the properties of bend working property, hardness and metal plating property were measured. For example, in alloy No. 3 in Table 2, the surface roughness was 0.35$\mu$ and in the bending workability in 90° W. bending at bending radius of 0.2 mmR, no crack was formed in parallel to rolling direction but cracks were formed at the right angle direction. Hardness was 148 Hv. There was no problem in the plating property in Ag plating and excellent lead frame material was obtained.

The alloys produced by the composition and production method as mentioned above have very excellent properties of tensile strength of 50–60 kg/mm$^2$, elongation of 6% and conductivity of about 35–50% and the production step comprises no precipitation hardening treatment and this process is economic and greatly advantageous for production of lead conductor for integrated circuits.

TABLE 2

| Ex. No. | Composition (%) Ni | Sn | P | Si | Mn | Balance Cu | At 6% of elongation Conductivity % IACS | Tensile strength kg/mm² |
|---|---|---|---|---|---|---|---|---|
| 1 | 1.2 | 0.7 | 0.2 | — | — | | 35.0 | 52 |
| 2 | 0.5 | 0.3 | 0.01 | — | — | | 49.4 | 45 |
| 3 | 1.0 | 0.5 | 0.05 | — | — | | 48.3 | 50 |
| 4 | 0.5 | 0.7 | 0.2 | — | — | | 37.0 | 46 |
| 5 | 1.2 | 0.3 | 0.1 | — | — | | 40.2 | 47 |
| 6 | 1.2 | 0.5 | 0.05 | 0.2 | 0.1 | | 36.5 | 50 |
| 7 | 1.0 | 0.5 | 0.05 | 0.1 | 0.3 | | 38.0 | 51 |
| 8 | 0.5 | 0.5 | 0.1 | — | 0.2 | | 37.0 | 52 |
| 9 | 0.7 | 0.5 | 0.2 | 0.3 | — | | 36.0 | 53 |
| 10 | 2.5 | 0.9 | 0.05 | — | — | | 41.4 | 60 |
| 11 | 3.0 | 0.7 | 0.06 | — | — | | 41.0 | 58 |
| 12 | 2.0 | 0.5 | 0.1 | — | — | | 39.5 | 51 |

What is claimed is:

1. Copper-nickel-tin alloys for electrical lead conductor materials for integrated circuits containing 0.5–3.0% by weight of Ni, 0.3–0.9% by weight of Sn, 0.01–0.05% by weight of P and 0–0.35% by weight of at least one of Mn and Si and the remainder copper.

2. A method for producing copper-nickel-tin alloys for electrical lead conductor materials for integrated circuits comprising as sequential steps melting a starting material containing 0.5–3.0% by weight of Ni, 0.3–0.9% by weight of Sn, 0.01–0.05% by weight of phosphorus and 0–0.35% by weight of at least one of Mn and Si and the remainder Cu; casting the molten metal; rolling the casting into a sheet having a thickness corresponding to more than 60% of cold reduction percent of the final necessary gauge; annealing said rolled sheet at a temperature of 300°–395° C. for 1 hour; cold rolling the annealed sheet; and annealing the cold rolled sheet at a temperature of 150°–250° 1 C. for 1 hour.

* * * * *

UNITED STATES PATENT AND TRADEMARK OFFICE

CERTIFICATE OF CORRECTION

PATENT NO. : 4,337,089

DATED : JUNE 29, 1982

INVENTOR(S) : Arita et al.

It is certified that error appears in the above-identified patent and that said Letters Patent are hereby corrected as shown below:

Claim 2, column 6, line 18, after "150°-250°" delete "1".

Signed and Sealed this

*Seventeenth* Day of *May 1983*

[SEAL]

*Attest:*

DONALD J. QUIGG

*Attesting Officer*

*Acting Commissioner of Patents and Trademarks*